137-13

8/25/87 OR 4,688,589

United States Patent [19]

Brainerd et al.

[11] Patent Number: 4,688,589

[45] Date of Patent: Aug. 25, 1987

[54] PIPELINE INJECTOR APPARATUS AND METHOD FOR USING SAME

[75] Inventors: Henry A. Brainerd; Charles W. Wilkerson; John R. Tyhurst, all of Independence, Kans.

[73] Assignee: Atlantic Richfield Company, Los Angeles, Calif.

[21] Appl. No.: 863,660

[22] Filed: May 15, 1986

[51] Int. Cl.[4] ..... F17D 1/17

[52] U.S. Cl. ..... 137/13; 137/605; 137/897

[58] Field of Search ..... 137/896, 897, 605, 3, 137/13, 801; 73/861.66; 261/116; 366/167, 173

[56] References Cited

U.S. PATENT DOCUMENTS

| | | | |
|---|---|---|---|
| 3,233,881 | 2/1966 | Smith | 261/116 X |
| 3,490,204 | 1/1970 | Kalika | 261/116 X |
| 3,900,043 | 8/1975 | Bowen et al. | 137/13 X |
| 4,246,920 | 1/1981 | McClaflin | 137/13 |
| 4,390,346 | 6/1983 | Cramer et al. | 137/896 X |
| 4,442,047 | 4/1984 | Johnson | 137/897 X |

FOREIGN PATENT DOCUMENTS

| | | | |
|---|---|---|---|
| 153922 | 4/1921 | United Kingdom | 261/116 |

*Primary Examiner*—Martin P. Schwadron
*Assistant Examiner*—Stephen M. Hepperle
*Attorney, Agent, or Firm*—Michael E. Martin; Frank J. Uxa

[57] ABSTRACT

An apparatus useful for introducing an additive material into a pipeline in which a primary material is flowing in a direction generally parallel to the centerline of the pipeline comprises: a probe located at least partially in the pipeline and in communication with an additive material source; and at least one first aperture and at least one second aperture located in the probe in the pipeline and acting as passageways for additive material from the additive source and the probe to the interior of the pipeline, provided that the first and second apertures are located away from the centerline of the pipeline and are oriented to face substantially downstream relative to the general flow of the primary material in the pipeline.

5 Claims, 2 Drawing Figures

PIPELINE INJECTOR APPARATUS AND METHOD FOR USING SAME

This invention relates to an improved apparatus for introducing an additive material into a pipeline. More particularly, the invention relates to an improved apparatus, and method for using same, useful for introducing or injecting an additive material, e. g., such as a drag reducing agent, into a pipeline which transports primary material, such as petroleum or a petroleum derived material.

Pipelines are widely used to transport liquids and slurries, such as crude petroleum, petroleum derived fractions or materials or products, coal-water slurries and the like, over long distances. In many situations, it is desirable to introduce or inject one or more additive materials into the primary material flowing in the pipeline, for example, to improve one or more properties or characteristics of the primary material or to improve the transportation efficiency of the pipeline. Included among such additive materials are drag reducing agents (DRA), e.g., comprising synthetic polymeric materials, which are added to the primary material flowing in the pipeline to increase the volume flowrate of the primary material or to reduce the amount of energy needed to maintain a constant primary material flowrate.

In most instances, additive materials must be at least partially mixed with the primary material in the pipeline in order to be effective. With some additive materials, care must be taken to avoid damaging the additive during the injection process. For example, many of the polymeric drag reducing agents are shear sensitive. That is, these polymers will deteriorate, or even be destroyed if subjected to a certain level of shear forces. Therefore, the system to inject such additive materials into a pipeline should avoid applying undue shear forces to the additive materials.

Many devices have been used in pipelines to measure various pressures and velocities. For example, a device sold by Dieterich Standard Corporation under the tradename Annubar is a differential pressure primary flow sensor designed for insertion into pipelines to measure the flow of liquids or gases. A typical Annubar device is situated in a pipeline with two impact ports on either side of the centerline of the pipeline facing upstream relative to the flow of the primary material in the pipeline. A single static tube points (or faces) downstream to sense the static line pressure. Available information regarding these devices does not suggest their use to inject additive materials into pipelines.

The following U.S. Pat. Nos. have been reviewed in preparing this application: 4,422,830; 3,865,136; 3,502,103; 3,822,721; 3,993,097; 3,175,571; 3,601,079; 4,462,429; 3,414,004; 3,900,043; 4,259,977; and 3,826,279. There continues to be a need for an improved additive material injection system into pipelines.

Therefore, one object of the present invention is to provide an improved apparatus useful for introducing additive materials into pipelines.

Another object of the present invention is to provide an improved method for introducing additive materials into pipelines.

A further object of the present invention is to provide an improved apparatus and method for introducing drag reducing agents into pipelines. Other objects and advantages of the present invention will become apparent hereinafter.

An improved apparatus useful for introducing an additive material from an additive source into a pipeline in which a primary material is flowing in a direction generally parallel to the centerline of the pipeline has been discovered. In one broad embodiment, the present apparatus comprises:

probe means at least partially located in the pipeline and in communication with the additive source; and at least one first aperture and at least one second aperture located in that portion of the probe means in the pipeline and acting as passageways for additive material from the additive source and the probe means to the interior of the pipeline, provided that the apertures are located away from the pipeline's centerline and are oriented to face substantially downstream relative to the general direction of flow of the primary material in the pipeline.

In another broad aspect, the present invention is directed toward an improved method for introducing an additive material into a pipeline in which a primary material is flowing in a direction generally parallel to the centerline of the pipeline. This method comprises:

positioning a probe means at least partially in the pipeline, the probe means being in communication with an additive material source and having at least one first aperture and at least one second aperture located in that portion of the probe means in the pipeline, the apertures being located away from the centerline of the pipeline and oriented to face substantially downstream relative to the general direction of flow of the primary material in the pipeline; and causing additive material to pass from the additive material source to the probe means and through the apertures into the interior of the pipeline.

The present apparatus and method are particularly useful when the additive material comprises a drag reducing agent, more particularly a shear sensitive drag reducing agent, such as various synthetic polymers which are utilized for their drag reducing properties. The primary material flowing in the pipeline preferably comprises a liquid (with or without included solids) and more preferably comprises petroleum or a petroleum derived material. The first and second apertures are placed away from the pipeline's centerline and, preferably at points in the pipeline where the velocity of the primary material through the pipeline is changing relatively rapidly. This placement of the apertures provides for improved mixing of the additive material and the primary material. Also, orienting the apertures to face substantially downstream relative to the flow of the primary material reduces the shear forces on the additive material as it passes through the apertures into the interior of the pipeline.

The probe means preferably intersects the centerline of the pipeline with the first apertures being located on one side of this centerline and the second apertures being located on the other side of the centerline. More preferably, the probe means is located substantially perpendicular to the centerline of the pipeline. Also, the probe means is preferably structured to be removeable from tne pipeline, e.g., to allow cleaning of the probe means or the pipeline.

In one preferred embodiment, a plurality of both first and second apertures are provided. More preferably the number of the first apertures and the number of the second apertures are independently selected and may be in the range of 2 to about 10. Thus, the number of first and second apertures need not be equal. The shortest distance between a first aperture and a second aperture is preferably in the range of about 10% to about 70%, more preferably about 20% to about 60%, of the diameter (the inside diameter) of the pipeline. The first and second apertures are preferably sized to reduce shear degradation of tne additive material.

These and other aspects and advantages of the present invention are set forth in the following detailed description and claims, particularly when considered in conjunction with the accompanying drawings in which like parts bear like reference numerals. In the drawings:

Figure 2:
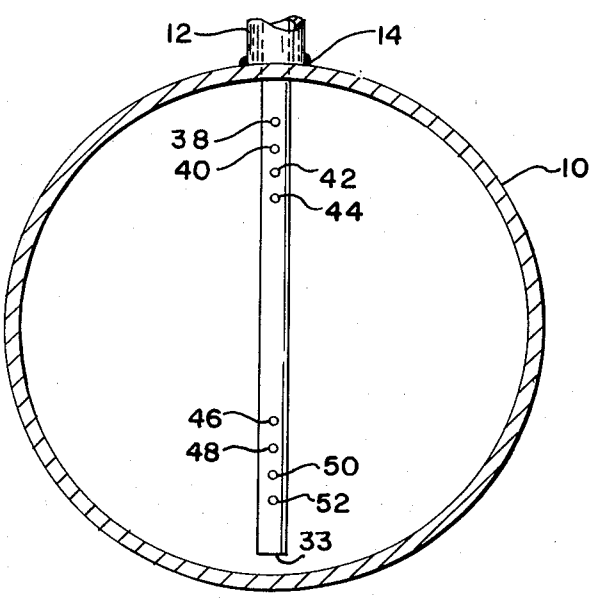
FIG. 2 is a plan view taken along line 2—2 of FIG. 1.
Figure 1:
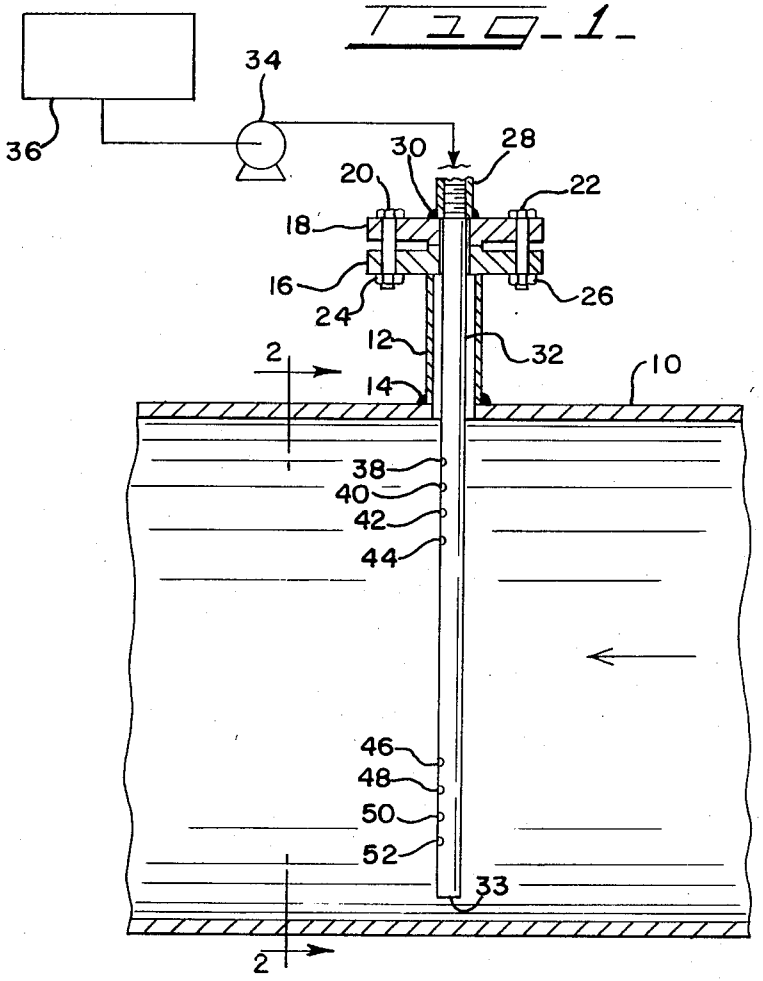
FIG. 1 is a schematic view, partly in cross-section, showing one embodiment of the present apparatus in use.

Referring now to the drawings, FIG. 1 shows a crude petroleum pipeline 10 in which is flowing (from right to left as shown in FIG. 1) crude petroleum. Pipeline 10 includes an elongated, hollow element 12 which is welded to pipeline 10 by weld 14. Element 12 is connected to bottom flange member 16 which, in turn is secured to top flange member 18 by bolts 20 and 22, and nuts 24 and 26. Extending upwardly from top flange member 18 is threaded nipple 28 which is secured in place by weld 30.

Probe 32 includes threads which engage the threads of threaded nipple 28. Probe 32 extends from threaded nipple 28 through top flange element 18 and bottom flange element 16, through hollow element 12 into pipeline 10. Probe 32, which is sealed at its bottom 33, is positioned to intersect and be perpendicular to the centerline of pipeline 10. Probe 32 is in fluid communication with drag reducer pump 34 and drag reducer supply tank 36. The shear sensitive drag reducer additive material in tank 36 may be any drag reducer, e.g., liquid synthetic polymer or diluted liquid snythetic polymer useful to reduce drag in pipeline 10 and thereby improve operational efficiency.

Probe 32 is hollow and included first apertures 38, 40, 42 and 44, and second apertures 46, 48, 50 and 52 which are all oriented to force generally downstream relative to the general direction of flow of the crude petroleum in pipeline 10. The shortest distance between the closest first and second apertures 44 and 46 is 44% of the inside diameter of pipeline 10. First and second apertures 38, 40, 42, 44, 46, 48, 50 and 52 are positioned away from the centerline of pipeline 10 at points along the cross-section of pipeline 10 where the velocity of the crude petroleum flowing in pipeline 10 changes relatively rapidly; and act as passageways for drag reducer from tank 36 pump 34 and probe 32 to enter the interior of the pipeline 10. The above noted orientation and positioning of the apertures provides for adequate mixing of crude petroleum and drag reducer which avoiding subjecting the drag reducer to undue destructive shear forces. With the drag reducer mixed with the crude petroleum in pipeline 10, the operational efficiency of pipeline 10 is improved.

Probe 32 can be easily removed from pipeline 10 by undoing bolt and nut combinations 20 and 24, and 22 and 26, respectively, separating top and bottom flange members 18 and 16, respectively, and disengaging the threads of probe 32 from threaded nipple 28.

First and second apertures 38, 40, 42, 44, 46, 48, 50 and 52 are sized so as not to unduly restrict the drag reducer from entering pipeline 10. Such undue restriction could result in relatively high shear forces which tend to cause drag reducer deterioration. The specific size of the apertures depends, for example, on the additive material being employed, the concentration of the additive material desired in pipeline 10 and the number of apertures.

The drag reducer injection system shown in the drawing functions as follows. When it is desired to add drag reducer from tank 36, probe is positioned into pipeline 10 as described above. Pump 34 is activated, causing a predetermined, effective amount of drag reducer to pass from tank 36 into probe 32, through first and second apertures 38, 40, 42, 44, 46, 48, 50 and 52 into pipeline 10 where it mixes with crude petroleum flowing in pipeline 10 to act to improve the operational efficiency of pipeline 10. Probe 32 can be easily removed from pipeline 10, as described above, to allow for cleaning of probe 32 or pipeline 10.

While the invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. An apparatus for injecting a shear sensitive drag reducing additive into a generally cylindrical petroleum pipeline in which viscous petroleum liquid is flowing through said pipeline in a direction generally parallel to the longitudinal centerline of said pipeline, said apparatus comprising:

an elongated tubular probe supported on said pipeline and extending generally transversely within said pipeline across major portion of the interior of said pipeline and on opposite sides of said longitudinal centerline, said tubular probe being adapted to be connected to a source of drag reducing additive;

a plurality of first apertures and a plurality of second apertures formed in said tubular probe and opening into said interior of said pipeline in a direction facing substantially downstream relative to the general direction of flow of said petroleum in said pipeline and being disposed in said interior of said pipeline in a region away from said longitudinal centerline and at points in said interior of said pipeline where the velocity of said petroleum changes relatively rapidly so as to provide for enhanced mixing of said additive with said petroleum and whereby the minimum spacing between said first apertures and said second apertures is at least about 44 percent of the inside diameter of said pipeline; and means for supporting said tubular probe for removal from the interior of said pipeline so that pipeline cleaning pigs and the like may be traversed therethrough.

2. The apparatus set forth in claim 1 wherein:

the number of said first apertures is in the range of from 2 to 10.

3. The apparatus set forth in claim 1 wherein:

the number of said second apertures is in the range of from 2 to 10.

4. A method for introducing a shear sensitive drag reducing additive material in the form of a synthetic polymer for reducing drag created by a primary petroleum liquid being pumped through a generally cylindrical petroleum pipeline and the like, said method comprising:

providing a probe characterized by an elongated tubular menber supported on said pipeline and extending generally transversely within said pipeline across a major portion of the interior of said pipeline and on opposite sides of the longitudinal centerline of said pipeline, said tubular member being adapted to be connected to a source of drag reducing additive, a plurality of first apertures and a plurality of second apertures formed in said tubular member and opening into said interior of said pipeline in a direction facing substantially downstream relative to the general direction of flow of said petroleum in said pipeline and being disposed in said interior of said pipeline in a region away from said centerline and at points in said interior of said pipeline where the velocity of said petroleum changes relatively rapidly so as to provide for enhanced mixing of said additive with said petroleum and whereby the minimum spacing between said first apertures and said second apertures is at least about 44 percent of the inside diameter of said pipeline, and means for supporting said tubular member for removal from the interior of said pipeline so that pipeline cleaning pigs and the like may be traversed therethrough; and causing said additive to pass from said source to said tubular member and through said apertures into the interior of said pipeline in the region of relatively rapid change of velocity of said petroleum so as to thoroughly mix with said petroleum and to reduce viscous drag forces of said petroleum being pumped through said pipeline.

5. The method set forth in claim 4 including the steps of:

providing said first and second apertures to each be in the range of from 2 to 10 in number and extending over a region of the interior of said pipeline measured normal to said centerline.

* * * * *